United States Patent [19]

Singer et al.

[11] 4,018,638

[45] Apr. 19, 1977

[54] METHOD OF REDUCING THE THICKNESS OF A WAFER OF FRAGILE MATERIAL

[75] Inventors: Barry M. Singer, New York; Joseph J. Lalak, Briarcliff Manor, both of N.Y.

[73] Assignee: North American Philips Corporation, New York, N.Y.

[22] Filed: Aug. 22, 1975

[21] Appl. No.: 606,967

[52] U.S. Cl. ..... 156/626; 156/345; 156/654; 350/97; 356/161

[51] Int. Cl.[2] ..... C23F 1/02

[58] Field of Search ..... 156/16, 17, 345, 8, 156/13; 356/161; 350/97

[56] References Cited

UNITED STATES PATENTS

| | | | |
|---|---|---|---|
| 2,549,566 | 4/1951 | Bentley et al. | 356/161 |
| 2,998,745 | 9/1961 | McClellan | 356/161 |
| 3,693,025 | 9/1972 | Brunton | 356/161 |
| 3,807,870 | 4/1974 | Kalman | 356/161 |
| 3,824,017 | 6/1974 | Galyon | 356/161 |
| 3,930,914 | 1/1976 | Hetrich | 156/16 |

OTHER PUBLICATIONS

Chawalow, L. L. E., "Etch Completion Indication," IBM Technical Disclosure Bulletin, vol. 15, No. 2, 7/72, p. 606.

*Primary Examiner*—Charles E. Van Horn
*Assistant Examiner*—Jerome W. Massi
*Attorney, Agent, or Firm*—Frank R. Trifari; Carl P. Steinhauser

[57] ABSTRACT

A method of reducing the thickness of a wafer of fragile material, e.g. pyroelectric material, by placing the wafer, supported only at its rim, in a holder filled with a non-corrosive liquid. The holder with the exposed surface of wafer is placed in an etch bath to reduce the thickness of the wafer. The wafer is removed from the etch bath, without removing it from the holder, to measure its thickness, using its index of refraction, which is facilitated by the presence of a bubble in the non-corrosive liquid.

4 Claims, 3 Drawing Figures

METHOD OF REDUCING THE THICKNESS OF A WAFER OF FRAGILE MATERIAL

The invention relates to a method of reducing the thickness of a wafer of fragile material, and in particular to the manufacture of a target for a pyroelectric vidicon.

Pyroelectric materials such as triglycine sulfate (TGS), deuterated triglycine fluoroborate (DTGFB), alanine doped triglycine sulphate (LATGS), etc., are all materials quite suitable for fabricating pyroelectric vidicons. These materials are all quite fragile when prepared into the shape and thickness for fabrication into targets suitable for pyroelectric vidicons. For the sake of simplicity, reference will be made hereinafter only to triglycine sulfate (TGS), but the same techniques that will be described are applicable to all pyroelectric materials, or even to other fragile materials requiring special and careful handling.

Great care must be taken in handling this extremely fragile material. Thus, a normal single crystal (TGS) vidicon uses a target 2 cm in diameter and 30 to 50 $\mu$m thick. This target normally is prepared by cutting, lapping, and polishing.

It is a principal object of the invention to provide a method of preparing a target for a pyroelectric vidicon which uses a chemical removal treatment to reduce the thickness of the target to a desired thickness and which avoids damage to the target while minimizing handling problems.

Further objects of the invention will appear as the specification progresses.

In accordance with the invention, we have developed a procedure for etching a relatively thick strong (TGS) disk into a thin membrane having a relatively strong outer rim without degrading its desireable pyroelectric properties. This development at the same time allows fabrication of thinner membranes than previously available when using standard grinding and polishing techniques. The dimension of the thick rim is not critical, only that the (TGS) be strong enough to be easily and safely handled, for example, using metal tweezers.

In accordance with the invention, the (TGS) disk is etched on one side while protecting the other. This is accomplished by using a specially designed holder into which the disk is placed and clamped at the rim. The holder is filled with a non-corrosive liquid leaving one surface of the disk exposed.

Thereafter, the holder with the exposed surface of the disk is placed in an etching solution to remove the (TGS) to a desired thickness. In order to ascertain the correct thickness of the (TGS), and consequently the length of time it must remain in the etching solution, the holder is periodically removed, and the web thickness of the (TGS) measured. The latter is facilitated by the presence of a small bubble remaining in the non-corrosive liquid which permits visible radiation transmitted through the (TGS) to be reflected back and by use of the index of refraction the thickness is determined.

After the desired thickness of the (TGS) is attained, the holder and disk are removed from the etching solution and carefully seperated. The disk is cleaned, dried, and prepared with appropriate electrodes for insertion into a vidicon tube assembly.

The invention will be described with reference to the accompanying drawing in which.

Figure 1:
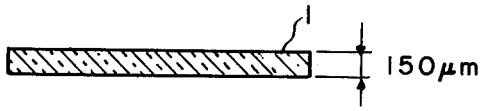
FIG. 1 is a sectional view of an initial (TGS) disk.
Figure 2:
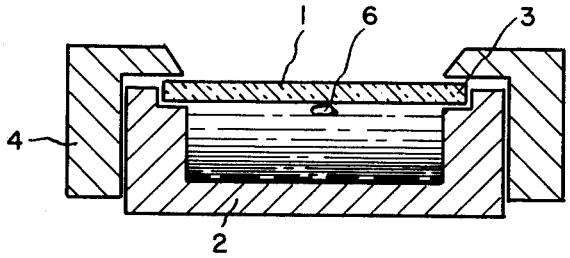
FIG. 2 is an elevational view in section of the disk placed in the holder.

An initial (TGS) disk 1 (FIG. 1), 150 $\mu$m thick, is placed in a holder (FIG. 2), the lower portion 2 supporting the disk 1 on its rim 3. The disc is clamped and held in place at the rim by an upper portion 4. The lower portion of the holder is filled with a non-corrosive liquid 5, e.g. iso-propyl alcohol. A small bubble 6 remains in the liquid after the disk is clamped between the upper and lower portions of the holder.

The center of the upper portion is open to allow an etchant, e.g. 40% distilled water and 60% isopropyl alcohol to etch the desired diameter. The etchant etches (TGS) at a rate of approximately 1.5 $\mu$m per minute. In order to promote uniform etching, the holder and disk rotate at an angle so that the liquid etchant rotates. The direction of rotation is changed every 15 seconds to cause good mixing and thus good uniform etching across the membrane is obtained.

The small bubble 6 is required to allow measurement of the (TGS) after initial etching and while still in the holder. A microscope (not shown) with a calibrated focus knob is used to make this measurement. Looking through the (TGS), one focusses on the bottom of the (TGS) and then on the top of the (TGS). By multiplying the measured difference by the index of refraction of the (TGS) — the index of refraction of (TGS) in the visible region is 1.6 — the thickness of the (TGS) can be measured with good accuracy below about 150 $\mu$m. Without the bubble, the bottom surface of the (TGS) cannot be seen. Therefore, one would have to estimate the required etch time and take the sample out to measure the thickness. The partially thinned sample is now too fragile to place back into the holder without breaking.

Figure 3:
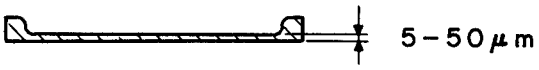
FIG. 3 is a sectional view of the thinned (TGS) target.

After the estimated thickness is reached, the holder with the (TGS) disk is taken out of the etch bath and rinsed with isopropyl alcohol. The exposed (TGS) surface is blown dry of isopropyl alcohol using dry nitrogen gas. The sample (FIG. 3) is immediately inspected for web thickness. If satisfactory, the wafer is immediately submerged in isopropyl alcohol and the holder pieces carefully separated. The (TGS) is then rinsed in isopropyl alcohol to be sure all traces of water are removed and then rinsed well in xylene and dried. The (TGS) sample (FIG. 3) is now ready to be prepared with appropriate electrodes for inserting into a vidicon and imaged.

What we claim is:

1. A method for reducing the thickness of a wafer of fragile material comprising the steps of placing the wafer supported at its rim in a holder filled with a non-corrosive liquid having a bubble in contact with one surface of the wafer, placing the holder with the exposed surface of the wafer in an etch bath to reduce the thickness of the wafer, transmitting visible radiation through the wafer which is reflected at the bubble and measuring the index of refraction of the wafer to said visible radiation without removing the wafer from the holder to determine the thickness thereof.

2. A method as claimed in claim 1 wherein the wafer is a pyroelectric material.

3. A method as claimed in claim 2 wherein the pyroelectric material is triglycine sulfate.

4. A method as claimed in claim 3 wherein the non-corrosive liquid is iso-propyl alcohol.

* * * * *